US011600143B2

(12) United States Patent
Nelson et al.

(10) Patent No.: US 11,600,143 B2
(45) Date of Patent: Mar. 7, 2023

(54) GROUP GAMING EVENTS AT GAMING DEVICES

(71) Applicant: IGT, Las Vegas, NV (US)

(72) Inventors: Dwayne Nelson, Las Vegas, NV (US); Christina Spaulding, Las Vegas, NV (US); Alison Kenney, Warwick, RI (US)

(73) Assignee: IGT, Las Vegas, NV (US)

( * ) Notice: Subject to any disclaimer, the term of this patent is extended or adjusted under 35 U.S.C. 154(b) by 107 days.

(21) Appl. No.: 17/031,521

(22) Filed: Sep. 24, 2020

(65) Prior Publication Data

US 2021/0082253 A1 Mar. 18, 2021

Related U.S. Application Data

(63) Continuation of application No. 16/110,581, filed on Aug. 23, 2018, now abandoned.

(51) Int. Cl.
*G07F 17/32* (2006.01)

(52) U.S. Cl.
CPC ..... *G07F 17/3272* (2013.01); *G07F 17/3225* (2013.01)

(58) Field of Classification Search
None
See application file for complete search history.

(56) References Cited

U.S. PATENT DOCUMENTS

2011/0092271 A1* 4/2011 Nguyen ..... G07F 17/3211 463/43
2013/0079073 A1* 3/2013 Sharifi ..... A63F 13/798 463/3
2014/0235338 A1* 8/2014 Hansson ..... A63F 13/533 463/31

* cited by examiner

*Primary Examiner* — Peter J Iannuzzi
(74) *Attorney, Agent, or Firm* — Sage Patent Group

(57) ABSTRACT

A primary game having a plurality of outcomes is provided to a first player of a first gaming device. In response to one of the plurality of outcomes, a first game asset for a secondary game is provided to the first player. The secondary game includes a contest between the first player having the first game asset and a second player having a second game asset, and an outcome of the contest of the secondary game is based at least in part on comparing a first asset value of the first game asset and a second asset value of the second game asset. In some examples, the secondary game may be a fantasy sports game, a deck building card game, or a scavenger hunt game, in which some or all of the assets are obtained via the primary game(s).

12 Claims, 9 Drawing Sheets

GROUP GAMING EVENTS AT GAMING DEVICES

FIELD

Embodiments described herein relate to gaming devices, and in particular to providing group gaming events at gaming devices.

BACKGROUND

Electronic and electro-mechanical gaming machines (EGMs) are systems that allow users to place a wager on the outcome of a random event, such as the spinning of mechanical or virtual reels or wheels, the playing of virtual cards, the rolling of mechanical or virtual dice, the random placement of tiles on a screen, etc. Manufacturers of EGMs have incorporated a number of enhancements to the EGMs to allow players to interact with the EGMs in new and more engaging ways. For example, early slot machines allowed player interaction by pulling a lever or arm on the machine. As mechanical slot machines were replaced by electronic slot machines, a range of new player interface devices became available to EGM designers and were subsequently incorporated into EGMs. Examples of such interface devices include electronic buttons, wheels, and, more recently, touchscreens and three dimensional display screens.

SUMMARY

Embodiments described herein relate to gaming devices, and in particular to providing group gaming events at gaming devices. According to some embodiments, a primary game having a plurality of outcomes is provided to a first player of a first gaming device. In response to one of the plurality of outcomes, a first game asset for a secondary game is provided to the first player. The secondary game includes a contest between the first player having the first game asset and a second player having a second game asset, and an outcome of the contest of the secondary game is based at least in part on comparing a first asset value of the first game asset and a second asset value of the second game asset. For example, the secondary game may be a fantasy sports game, a deck building card game, or a scavenger hunt game, in which some or all of the assets are obtained via the primary game(s).

According to some embodiments, a computer-implemented method includes providing, via a first gaming device including a first processing circuit, a primary game to a first player of the first gaming device, the primary game including a plurality of outcomes. The method further includes, in response to one of the plurality of outcomes, providing, via the first gaming device, a first game asset for a secondary game to the first player. The secondary game includes a contest between the first player having the first game asset and a second player having a second game asset, wherein an outcome of the contest of the secondary game is based at least in part on comparing a first asset value of the first game asset and a second asset value of the second game asset.

According to further embodiments, a gaming system includes a first gaming device including a first processing circuit, a first display coupled to the first processing circuit, and a first memory coupled to the first processing circuit. The first memory includes machine readable instructions that, when executed by the first processing circuit, cause the first processing circuit to provide, via the display, a primary game to a first player of the first gaming device, the primary game including a plurality of outcomes. The first memory further includes machine readable instructions that, when executed by the first processing circuit, cause the first processing circuit to, in response to one of the plurality of outcomes, provide a first game asset for a secondary game to the first player. The secondary game includes a contest between the first player having the first game asset and a second player having a second game asset, wherein an outcome of the contest of the secondary game is based at least in part on comparing a first asset value of the first game asset and a second asset value of the second game asset.

According to further embodiments, a computer program product includes a computer-readable medium including machine readable instruction that, when executed by the first processing circuit of a first gaming device, provide, via a first gaming device including the processing circuit, a primary game to a first player of the first gaming device, the primary game including a plurality of outcomes. The computer-readable medium further includes that, when executed by the first processing circuit of a first gaming device, in response to one of the plurality of outcomes, provide, via the first gaming device, a first game asset for a secondary game to the first player. The secondary game includes a contest between the first player having the first game asset and a second player having a second game asset, wherein an outcome of the contest of the secondary game is based at least in part on comparing a first asset value of the first game asset and a second asset value of the second game asset.

These and other examples will be described in detail below.

DETAILED DESCRIPTION

Embodiments described herein relate to gaming devices, and in particular to providing group gaming events via gaming devices. According to some embodiments, a primary game having a plurality of outcomes is provided to a first player of a first gaming device. In response to one of the plurality of outcomes, a first game asset for a secondary game is provided to the first player. The secondary game includes a contest between the first player having the first game asset and a second player having a second game asset, and an outcome of the contest of the secondary game is based at least in part on comparing a first asset value of the first game asset and a second asset value of the second game asset. For example, the secondary game may be a fantasy sports game, a deck building card game, or a scavenger hunt game, in which some or all of the assets are obtained via the primary game(s).

Figure 1:
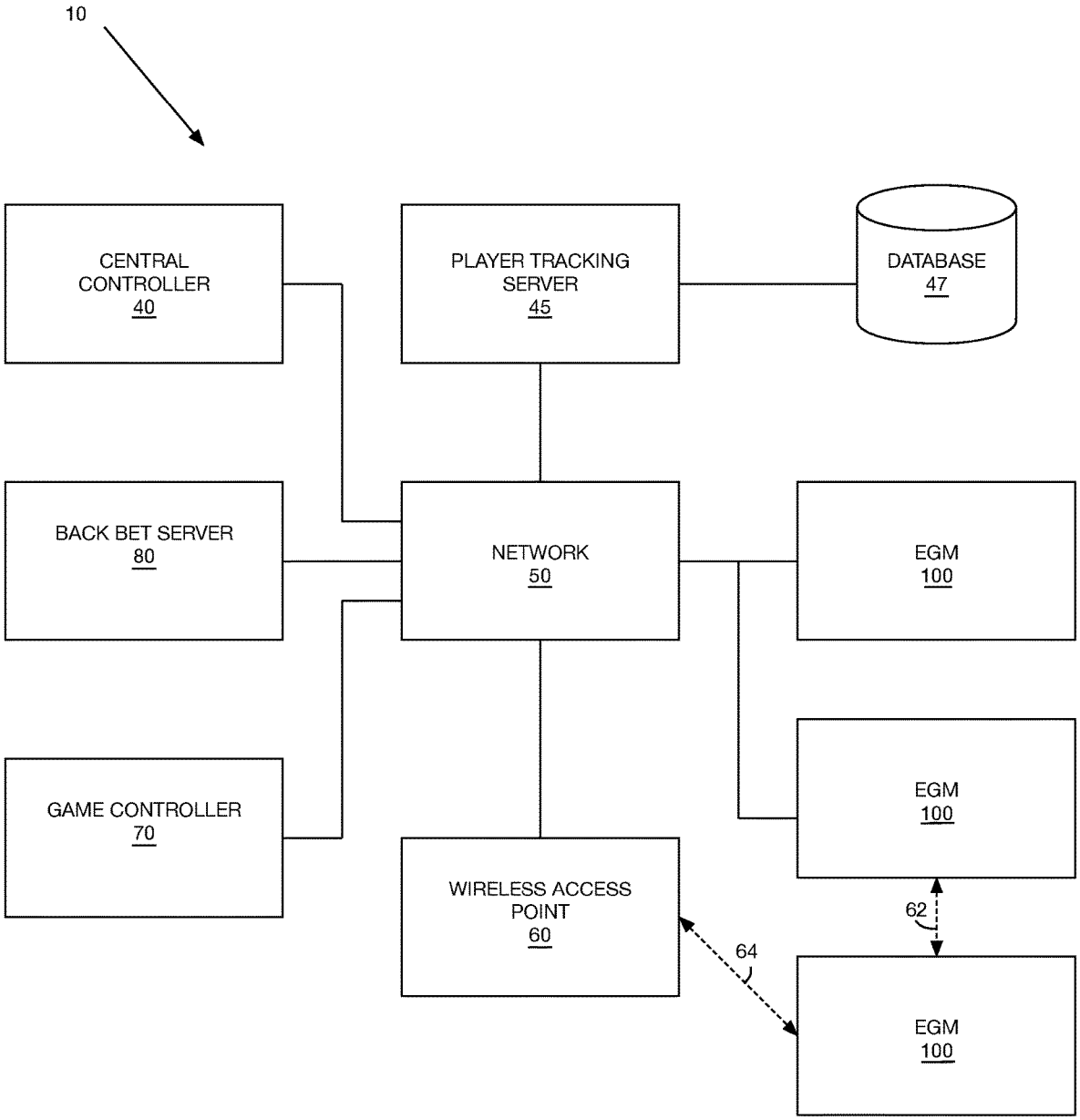
FIG. 1 is a schematic block diagram illustrating a network configuration for a plurality of gaming devices according to some embodiments.

Referring to FIG. 1, a gaming system 10 including a plurality of EGMs 100 is illustrated. The gaming system 10 may be located, for example, on the premises of a gaming establishment, such as a casino. The EGMs 100, which are typically situated on a casino floor, may be in communication with each other and/or at least one central controller 40 through a data network or remote communication link 50. The data communication network 50 may be a private data communication network that is operated, for example, by the gaming facility that operates the EGM 100. Communications over the data communication network 50 may be encrypted for security. The central controller 40 may be any suitable server or computing device which includes at least one processing circuit, or processor, and at least one memory or storage device. Each EGM 100 may include a processor that transmits and receives events, messages, commands or any other suitable data or signal between the EGM 100 and the central controller 40. The EGM processor is operable to execute such communicated events, messages or commands in conjunction with the operation of the EGM. Moreover, the processor of the central controller 40 is configured to transmit and receive events, messages, commands or any other suitable data or signal between the central controller 40 and each of the individual EGMs 100. In some embodiments, one or more of the functions of the central controller 40 may be performed by one or more EGM processors. Moreover, in some embodiments, one or more of the functions of one or more EGM processors as disclosed herein may be performed by the central controller 40.

A wireless access point 60 provides wireless access to the data communication network 50. The wireless access point 60 may be connected to the data communication network 50 as illustrated in FIG. 1, or may be connected directly to the central controller 40 or another server connected to the data communication network 50.

A player tracking server 45 may also be connected through the data communication network 50. The player tracking server 45 may manage a player tracking account that tracks the player's gameplay and spending and/or other player preferences and customizations, manages loyalty awards for the player, manages funds deposited or advanced on behalf of the player, and other functions. Player information managed by the player tracking server 45 may be stored in a player information database 47.

As further illustrated in FIG. 1, the EGMs 100 of the system 10 provide primary games and/or secondary games to users of the EGMs 100. Each EGM 100 may include standalone game content, and may also communicate with one or more elements of the system 10 to provide game content to a player of the EGMs 100.

For example, in some embodiments, the EGM 100 may communicate with other components of the system 10 over a wireless interface 62, which may be a WiFi link, a Bluetooth link, an NFC link, etc. In other embodiments, the EGM 100 may communicate with the data communication network 50 (and devices connected thereto, including EGMs) over a wireless interface 64 with the wireless access point 60. The wireless interface 64 may include a WiFi link, a Bluetooth link, an NFC link, etc. In still further embodiments, the EGM 100 may communicate simultaneously with other components of the system 10 over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a WiFi link.

In some embodiments, the gaming system 10 includes a game controller 70. The game 70 may be a computing system that communicates through the data communication network 50 with the EGMs 100 to coordinate the provision of primary game content and/or secondary game content to one or more players using the EGMs 100. The game controller 70 may be implemented within or separately from the central controller 40.

In some embodiments, the game 70 may coordinate the generation and display of elements of the same primary game and/or secondary game to more than one player by more than one EGM 100. As described in more detail below, this may enable multiple players to interact with elements within the game and/or with each other in real time. This feature can be used to provide a shared multiplayer experience to multiple players at the same time. Moreover, in some embodiments, the game controller 70 may coordinate the generation and display of the same game elements to players at different EGMs 100 at a common physical location, e.g., in a common bank of EGMs 100, or at different physical locations, e.g., at different locations within a casino or at different locations at different casinos or other gaming establishments.

In some embodiments, at least some processing of game content, including images and/or objects that are provides by the EGMs 100 may be performed by the game controller 70, thereby offloading at least some processing requirements from the EGMs 100.

A back bet server 80 may be provided to manage back bets placed using an EGM 100 as described in more detail below. An EGM 100 may communicate with the back bet server 80 through the wireless interface 64 and network 50, for example.

Figure 2:
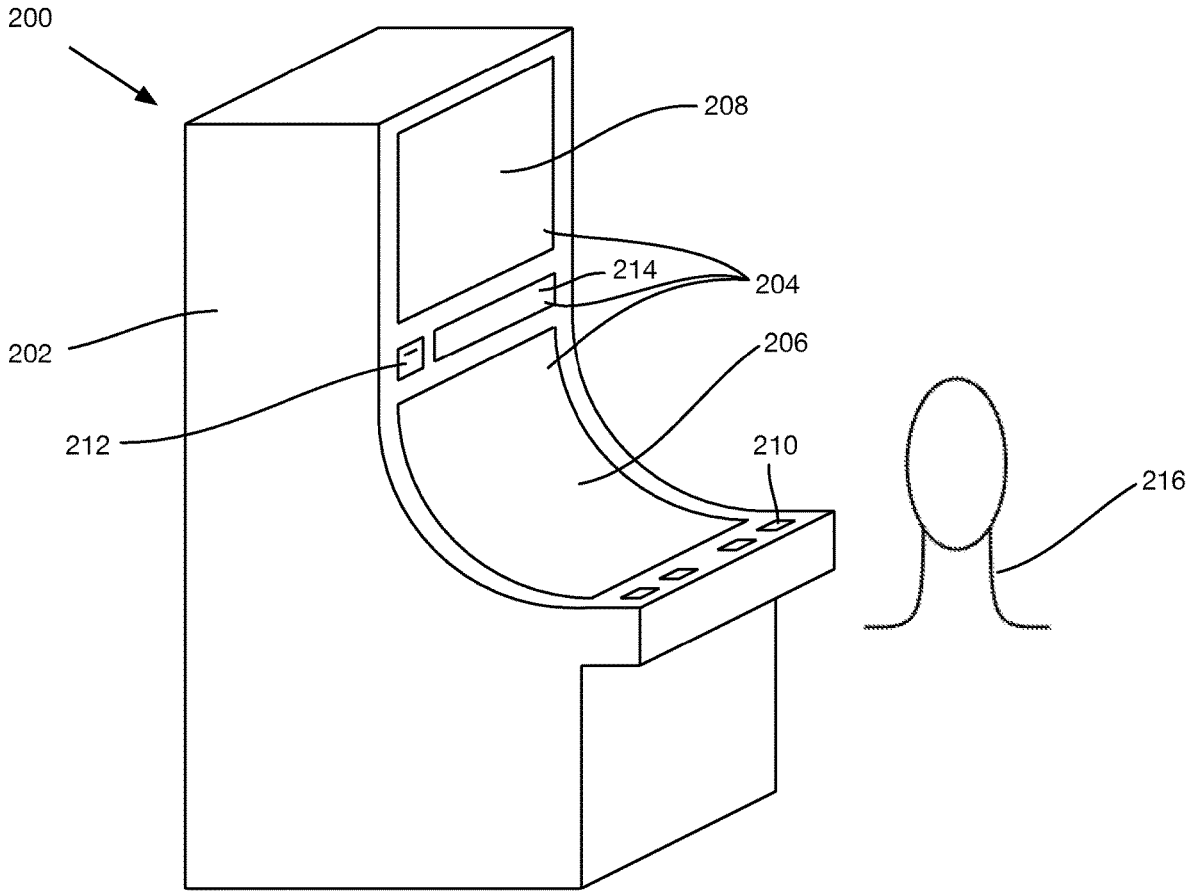
FIG. 2 illustrates an EGM for providing a primary game and/or secondary game according to various embodiments.

Referring now to FIG. 2, an EGM 200 is disclosed according to some embodiments. The EGM 200 of FIG. 2 includes a housing 202 and one or more displays 204 for providing information to a user 216 and/or receiving input from the user 216. In this example, the EGM includes a primary display 206 for providing one or more primary games to the user 216, and a secondary display 208 for providing additional information to the user 216, such as a secondary game, additional aspects of the primary game, promotional information or advertising, or other information. The EGM 200 may include one or more input devices 210, such as buttons, for example, to allow the user 216 to interact with the primary game or other aspects of the EGM 200. The input devices 210 may be mechanical buttons or touch-sensitive areas on one of the displays 204 or other parts of the housing 202, for example.

The EGM 200 may also include a payment mechanism 212, which may include a coin and/or bill acceptor, a coin and/or bill dispenser, an electronic card reader including a magnetic and/or chip-based reader, and/or a wireless reader including a near-field communication (NFC), Bluetooth, Wi-Fi, or other type of wireless interface, for example. The EGM 200 may also include a tertiary display 214 for displaying additional information to the user 216, such as player information, progressive jackpot information, or other information, as desired.

Figure 3:
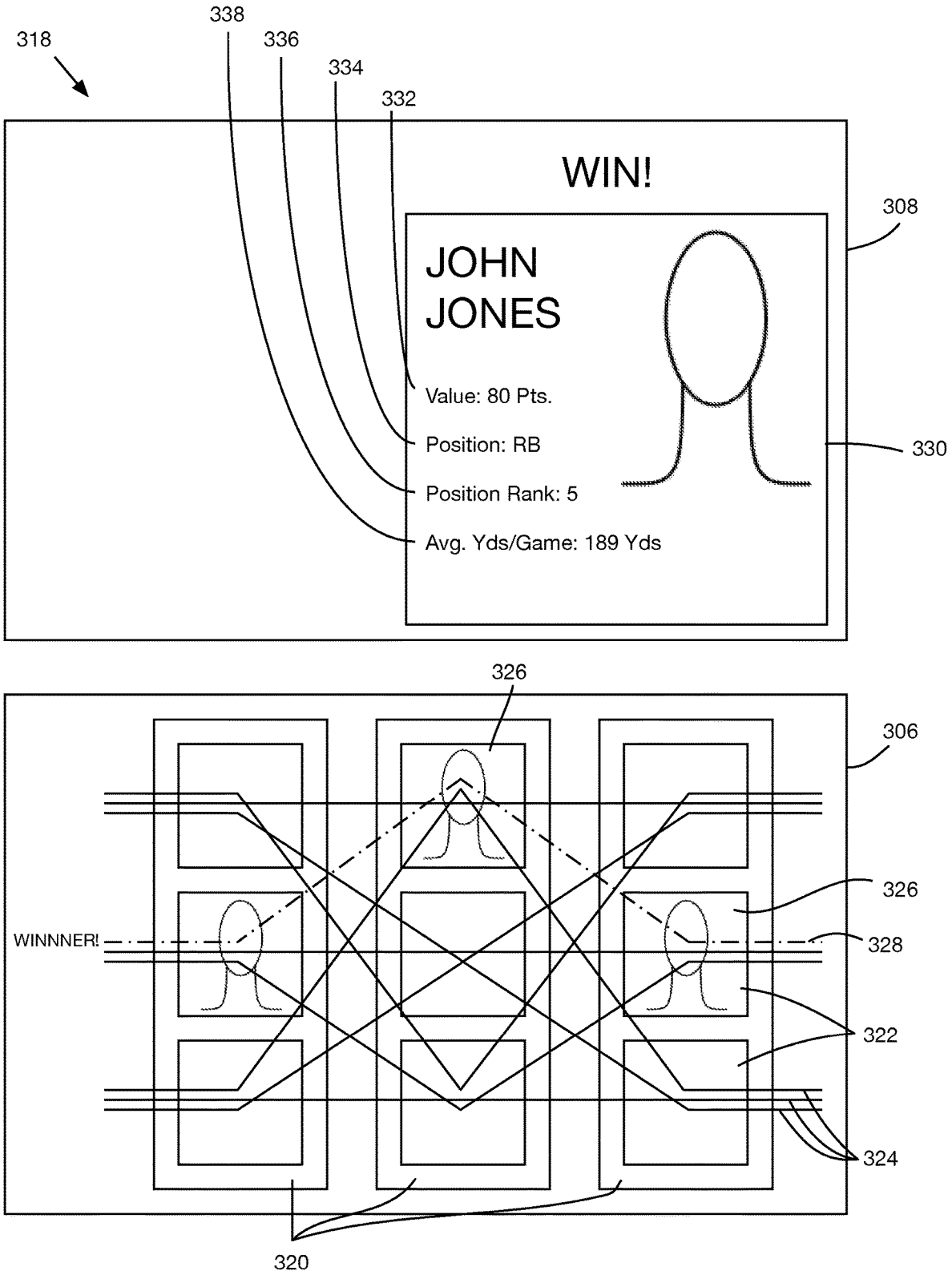
FIG. 3 illustrates a graphical user interface for a primary game at an EGM, with an award associated with a primary game including an asset for a secondary game, according to some embodiments.

Referring now to FIG. 3, a graphical user interface (GUI) 318 for a primary game shown on one or more displays 304 at an EGM, such as the EGM 200 of FIG. 2, is illustrated. In the embodiment of FIG. 3, the primary game is a casino-style slot game with a plurality of real or virtual reels 320 displayed on the primary display 306, with each reel 320 having a plurality of different game symbols 322. It should be understood that, while this and other examples refer to a primary game, aspects may be used with other types of games, such as secondary games, for example, as desired. In this example, during play of the primary game, the user activates a spin function to cause the reels 320 to spin and arrange the symbols 322 randomly or semi-randomly in an array. A plurality of paylines 324 extend across the reels 320 in different patterns, with different combinations of symbols 322 across different paylines 324 corresponding to different game outcomes, including winning game outcomes. Each winning game outcome may have an associated game award that is provided to the user. The game award may include a monetary award, such as real or virtual currency, casino credit, or other currency-based award, or may be a non-monetary award, such as an increase in player status or increased odds on future gaming activity by the user, for example. It should be understood that, while the primary game in this embodiment is a casino-style slot game, other primary games are contemplated, such as, for example, video poker games, skill-based games, virtual casino-style table games, sports betting terminals, electronic table games, social games, or other casino or non-casino style games, as desired.

As shown in FIG. 3, one of the winning game outcomes corresponds to a plurality of winning symbols 326 arranged along a winning payline 328, with the game award for the winning game outcome being a game asset 330 for a secondary game, which is displayed on the secondary screen 308 in this example. In this example, the secondary game is a fantasy sports game, and the game asset 330 is a fantasy sports player, but as discussed in greater detail below, it should be understood that other types of secondary games are contemplated, such as deck-building card games, scavenger hunt games, or other secondary games in which different players compete against each other using the game assets obtained through various primary games and other sources.

In this example, the game asset 330 is a player that includes information about a fantasy sports player (e.g., a fantasy football player) corresponding to a real-world football player. Information about the player 330 is displayed on the secondary display 308 in this example, including a point value 332 for the player 330 in the secondary game and a player position 334 within the secondary game. It should be understood that the point value 332 or other asset value may be related to a ranking of the asset 330 or an actual or projected score associated with the asset 330, which may be based on game events during a fantasy sports game match, and which may be associated with the respective fantasy sports team members. In some examples, some or all of the players 330 may be associated with a respective real-world sports team member, and the point value 332 or other values may be based on a real-world game event associated with the respective real-world sports team member.

The information may also include a position rank 336 indicating a rank of the player 330 at the player's position 334, real-world or virtual play statistics 338 for the player 330, and a portrait 340 of the player. In this example, the portrait 340 may be the same as or similar to the winning symbols 326 in the winning payline 328 of the primary game that resulted in the winning outcome that awarded the player 330 to the user 316.

While the above example describes a fantasy football player corresponding to a real-world football player, it should be understood that the disclosure is not so limited. For example, the secondary game may be directed to different sports or competitive activities, and the players may correspond to real-world, fictional, semi-fictional, or composite players having aspects of one or more real or virtual players.

Figure 4:
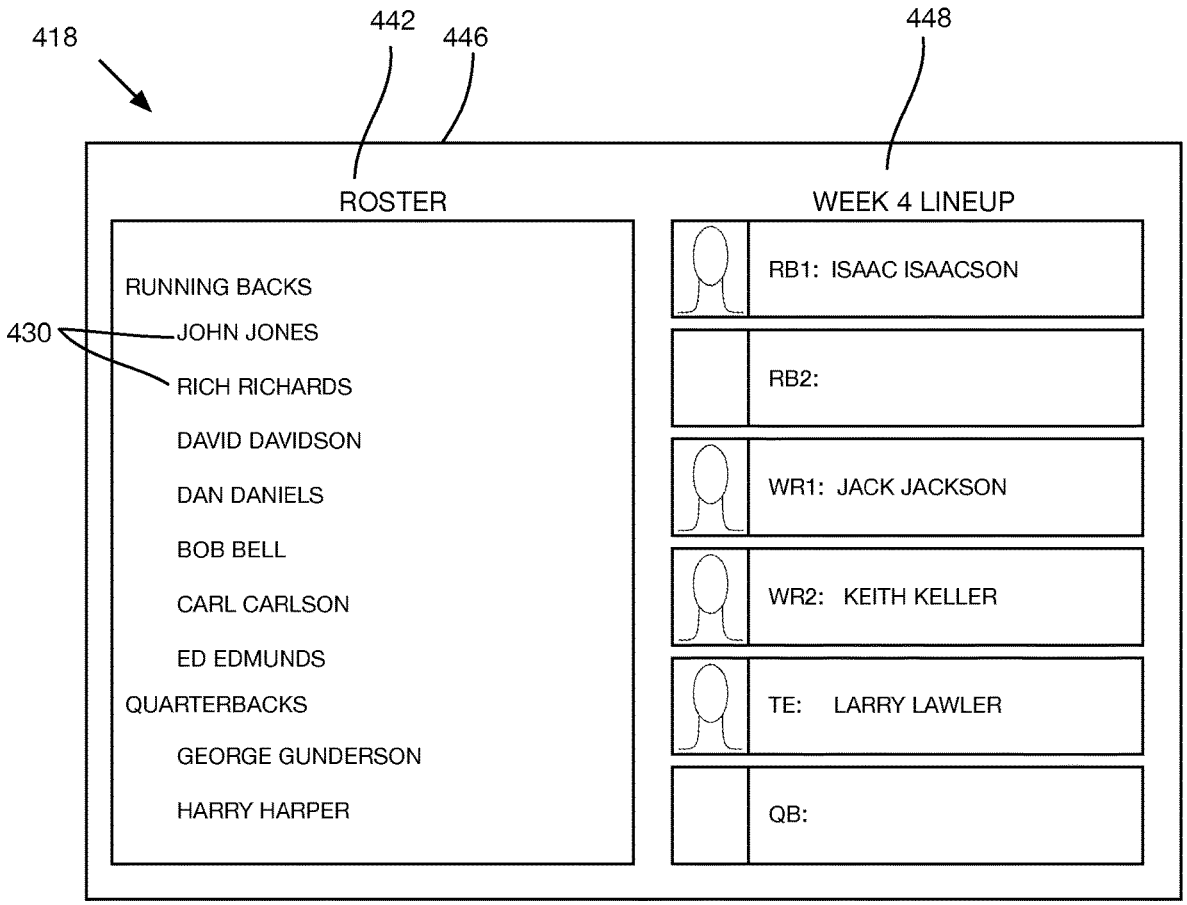
FIG. 4 illustrates a graphical user interface for managing a fantasy sports game using the assets obtained during play of the primary game of FIG. 3, according to some embodiments.

Referring now to FIG. 4, a GUI 418 for managing a fantasy sports game using assets 430 obtained during play of a primary game, such as the primary game of FIG. 3, for example, is illustrated. As with many social games and other types of games, the fantasy sports game in this embodiment has a management mode 446, illustrated in FIG. 4, and a competition mode, which will be described in greater detail in reference to FIG. 5. In the management mode 446 of FIG. 4, the user may view and interact with lists of assets 430 that may be used in connection with the competition mode of the game. In this example, one list of assets is a roster 442 of available fantasy sports players 430. The fantasy sports players 430 may be obtained by the player in a number of ways, including as part of a game award for the primary game of FIG. 3, for example, through points associated with a player's status or gaming activity, through a fantasy draft or auction as part of or separate from other gaming activity, or through direct purchase by the user, for example.

Another list of assets may be a lineup 448 of players 430 for a particular match, with subsets of different players 430 assigned to different positions 550 on a virtual team having virtual team members. The lineup 448 and/or roster 442 may also include additional information, such as an information described above with respect to FIG. 3, to help the user select players 430 for a particular match. It should be understood that assets 430 may be transferred, e.g., purchased, sold, and/or traded or exchanged for another asset 430, to other users upon request prior to, during, or after matches.

Figure 5:
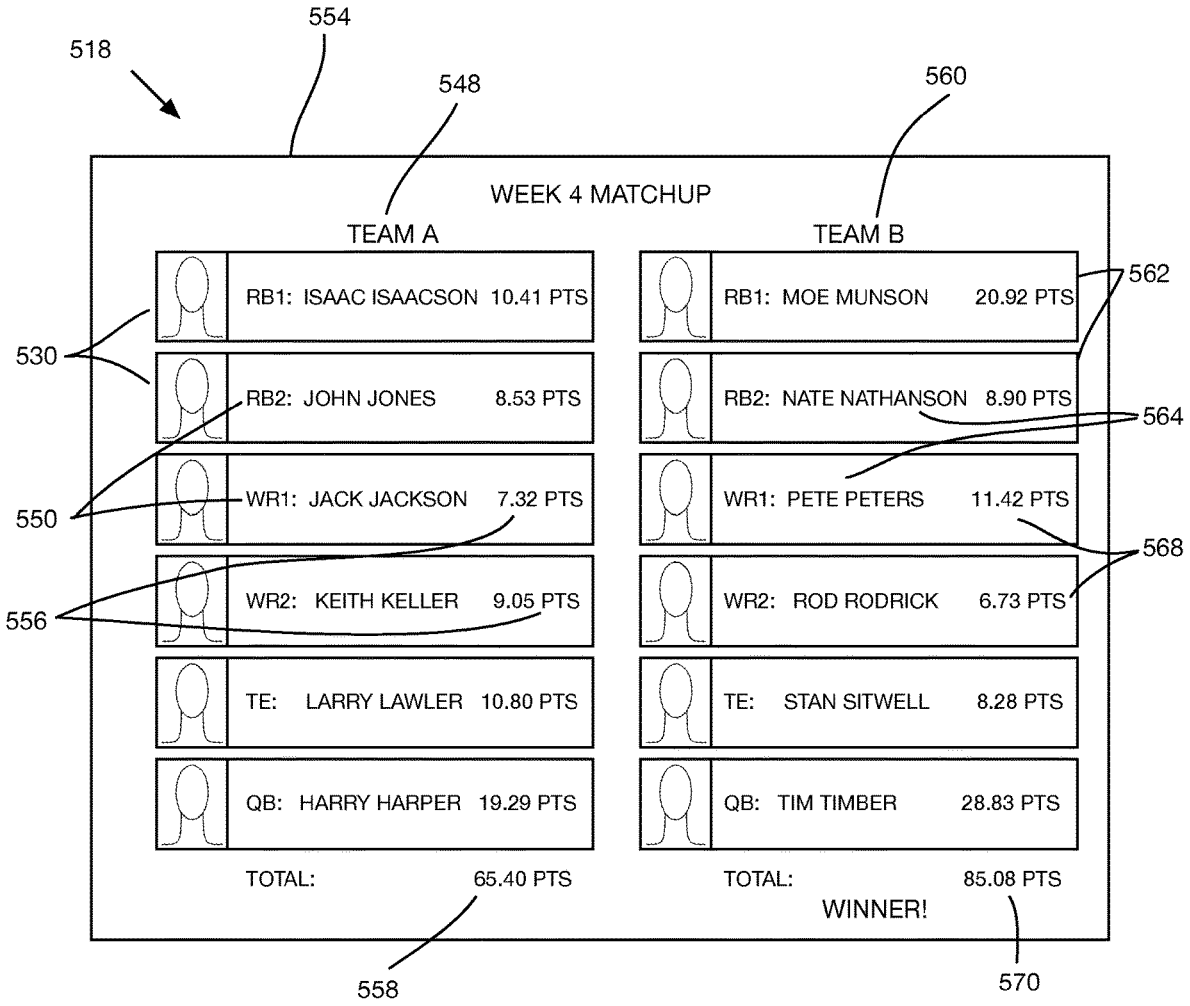
FIG. 5 illustrates graphical user interface for playing fantasy sports game match as part of the fantasy sports game of FIG. 4 against one or more opponents, according to some embodiments.

Referring now to FIG. 5, a GUI 518 for playing a fantasy sports game match, i.e., in a competition mode 554, using a lineup 530 selected in a management mode, such as the management mode 446 of FIG. 4, for example, against one or more opponents is illustrated. In the competition mode 554 of FIG. 5, the user's lineup 548 lists the players 530 selected by the user and the associated positions 550. During competition mode 554, the GUI updates the actual scores 556 for each player in real time. In this embodiment, scores are based on real-world play by the real-world counterpart for the player 530, but it should be understood that any type of scoring or rules system may be used for generating an actual score 556, such as virtual game events resulting in points being awarded to one or more players 530.

In competition mode 554, the user's lineup 548 and associated score total 558, is matched up against an opponent's lineup 560, which contains a similar list of different players 562 at complementary positions 564, actual scores 568 for each player 562. The opponent's lineup 560 may be selected by a real-world opponent, such as another user of another gaming device, or a virtual opponent, as desired. A score total 570 for the opponent's lineup 560 is compared with the score total 558 of the user's lineup 548 to determine a winner of the match, which may include an award for one or both players. It should also be understood that other examples are contemplated, including other types of contests between players having respective game assets, with an outcome of the contest being based at least in part on comparing a first asset value of the first game asset and a second asset value of the second game asset. It should be understood that the interface elements described herein may be displayed on any number or type of device, such as an EGM, a service window, a mobile device, or a personal computer, for example, as desired.

For example, in some embodiments, asset values for different assets may be generated via the EGM or a different gaming device, which may be at a different location than the EGM, in response to at least one game event during play of the secondary game. In some examples, in response to determining that the player status of a user is higher than a threshold status, a game asset having a higher rank than a threshold rank may be selected and awarded to the player. Based on the different asset values, an outcome of the secondary game can be generated and a secondary game award can be awarded to one or more players competing in the secondary game. For example, after providing a game asset to a user via the first EGM at a first location, the EGM may direct the first player to a second EGM at a second location different from the first location to play the secondary game.

In some embodiments, the player may win points or dollar amounts through play of the primary game. The player may retain these points or dollar amounts and purchase game assets, such as players or a team, at a later time. In one example, a player may start with a $50,000 budget in virtual dollars for team building, and may win an additional $1,000 in virtual dollars for team building through play of the primary game. The player can later use the $51,000 in virtual dollars to build a team.

As noted above, other types of secondary games with different types of game assets are contemplated, such as deck-building card games, for example, are contemplated. In this regard, FIG. 6 illustrates a GUI 618 for managing a deck-building card game using assets obtained during play of a primary game similar to the primary game of FIG. 3, for example.

Figure 6:
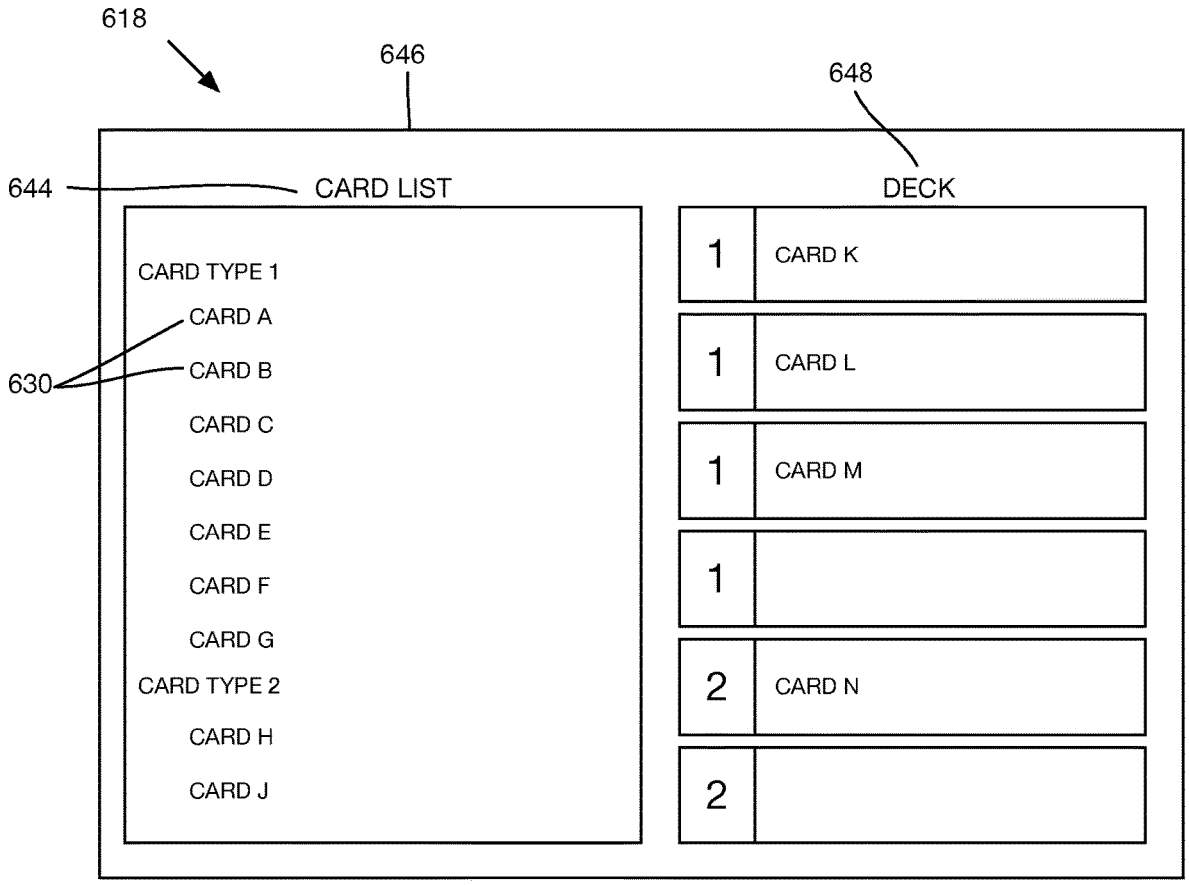
FIG. 6 illustrates a graphical user interface for managing a deck-building card game using the assets obtained during play of a primary game, according to some embodiments.

In a management mode 646 of FIG. 6 for the deck-building card game, the user may view lists of assets 630 that may be used in the game. In this example, one list of assets is a list of available game cards 630. The game cards may be obtained by the player in a number of ways, including as part of a game award for a primary game similar to the primary game of FIG. 3, through points associated with a player's status or gaming activity, through a fantasy draft or auction, or through direct purchase of the assets by the player, for example.

Another list of assets may be a deck 648 of cards for a particular match, with a subset of the available cards 630 grouped into a deck 648 that can be used during the match. It should be understood that embodiments described herein may be used with different types of deck building card games or other types of games, such as scavenger hunt games with assets including scavenger hunt items with respective point values for the scavenger hunt game, for example.

Figure 7:
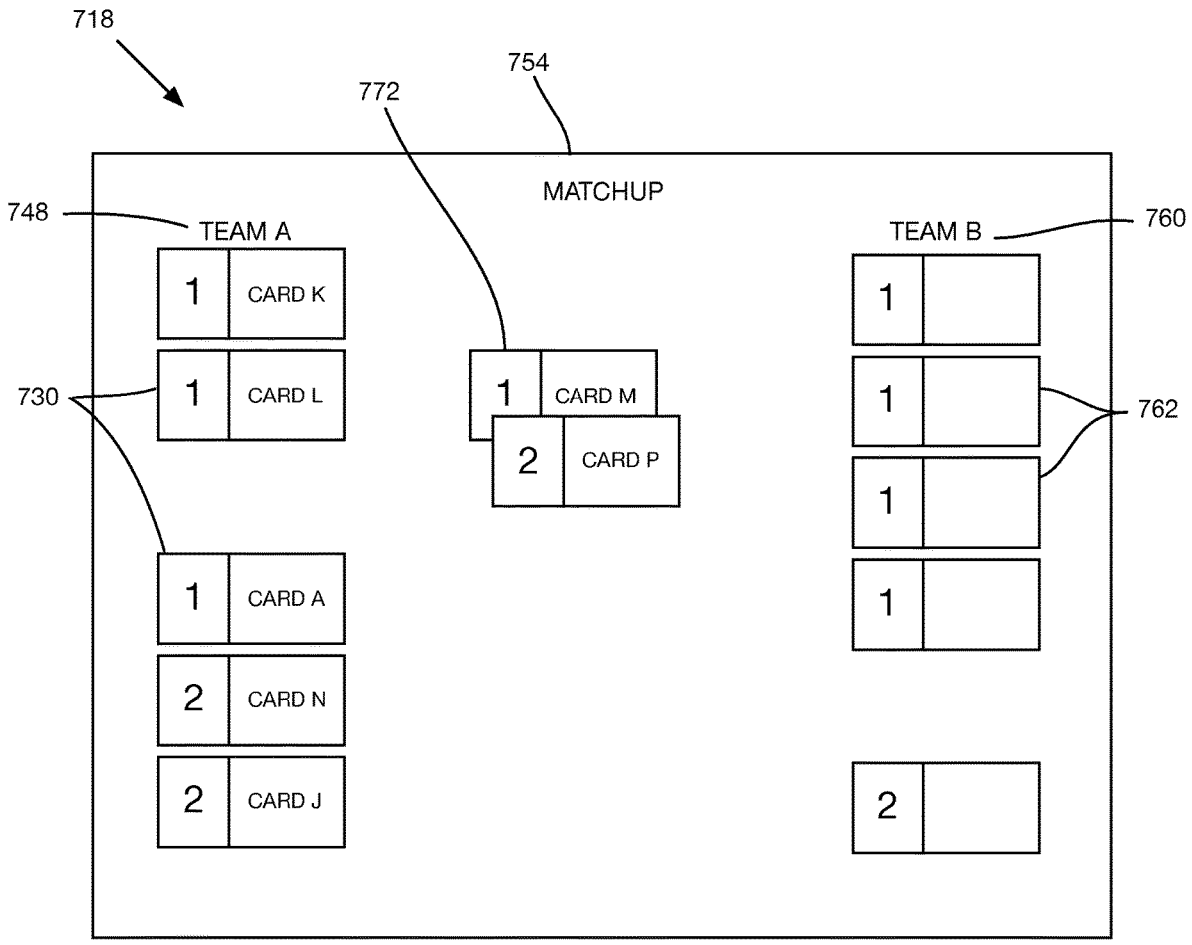
FIG. 7 illustrates graphical user interface for playing deck-building card game match as part of the deck-building card game of FIG. 6 against one or more opponents, according to some embodiments.

Referring now to FIG. 7, a graphical user interface 718 for playing a deck-building card game match as part of the deck-building card game of FIG. 6 against one or more opponents is illustrated. The user plays different cards 730, selected in advance as part of the management mode 646 of FIG. 6, against the cards 762 of an opponent's deck 760, with the in-play cards 772 determining a final score and/or result for the match. In this example, the deck selected by the user may be concealed from the user's opponent and vice versa.

Figure 8:
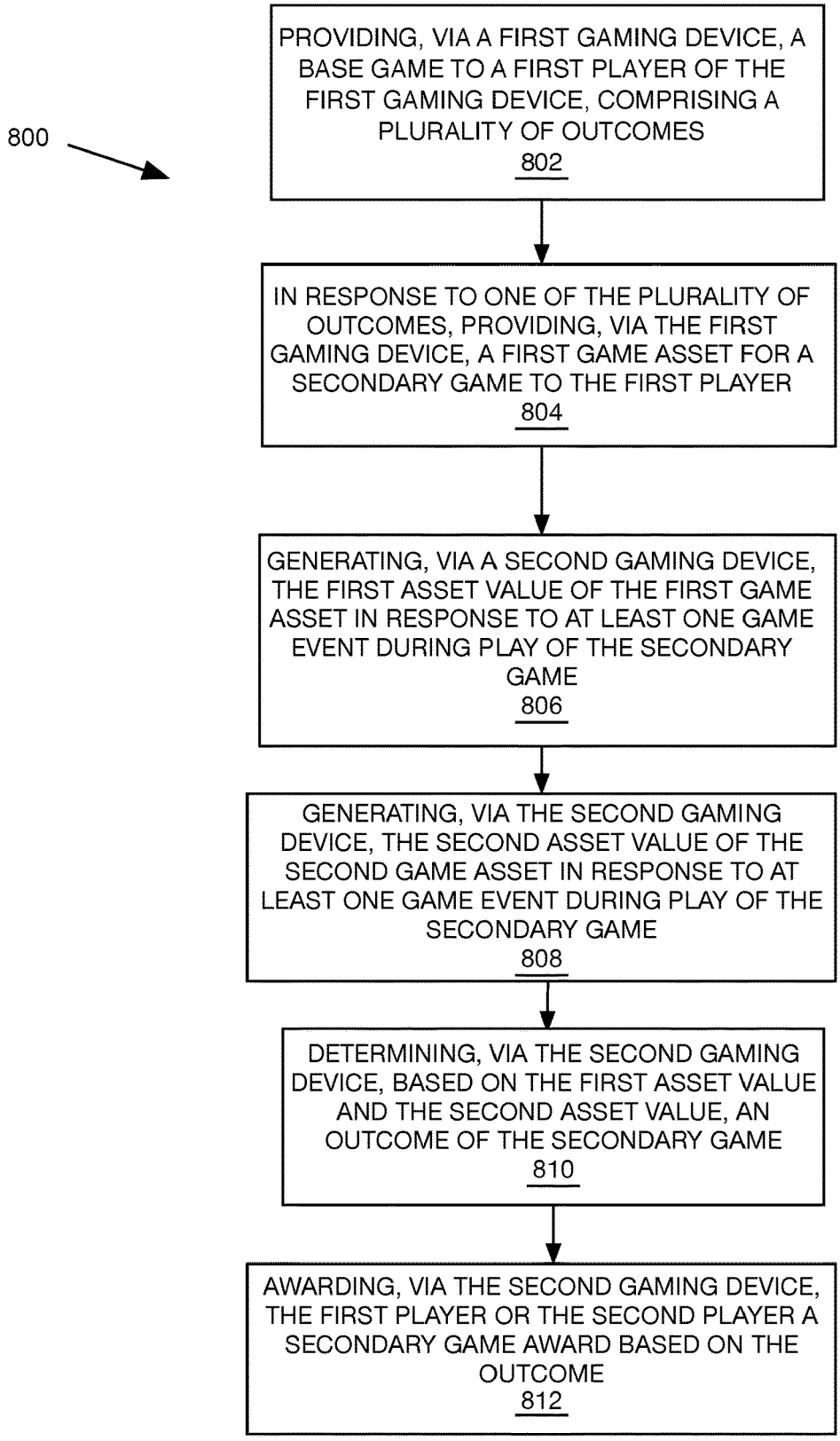
FIG. 8 is a flowchart diagram of a method of playing a primary game, and managing and playing a secondary game using assets obtained in the primary game, according to some embodiments.

FIG. 8 is a flowchart diagram of a method 800 of playing a primary game, and managing and playing a secondary game using assets obtained in the primary game, according to an embodiment. The method 800, which may be computer-implemented, includes providing, via a first gaming device including a first processing circuit, a primary game to a first player of the first gaming device, the primary game including a plurality of outcomes (Block 802). The method 800 further includes, in response to one of the plurality of outcomes, providing, via the first gaming device, a first game asset for a secondary game to the first player (Block 804). In this example, the secondary game includes a contest between the first player having the first game asset and a second player having a second game asset, with an outcome of the contest of the secondary game being based at least in part on comparing a first asset value of the first game asset and a second asset value of the second game asset. The method 800 may also include generating, via a second gaming device including a second processing circuit, the first asset value of the first game asset in response to at least one game event during play of the secondary game (Block 806). The method 800 may also include generating, via the second gaming device, the second asset value of the second game asset in response to at least one game event during play of the secondary game (Block 808). The method may also include determining, via the second gaming device, based on the first asset value and the second asset value, an outcome of the secondary game (Block 810). The method 800 may also include awarding, via the second gaming device, the first player or the second player a secondary game award based on the outcome (Block 812). It should be noted that, while the primary game is played at a first gaming device, and the secondary game is played at a second gaming device in this embodiment, the disclosure is not so limited.

Figure 9:
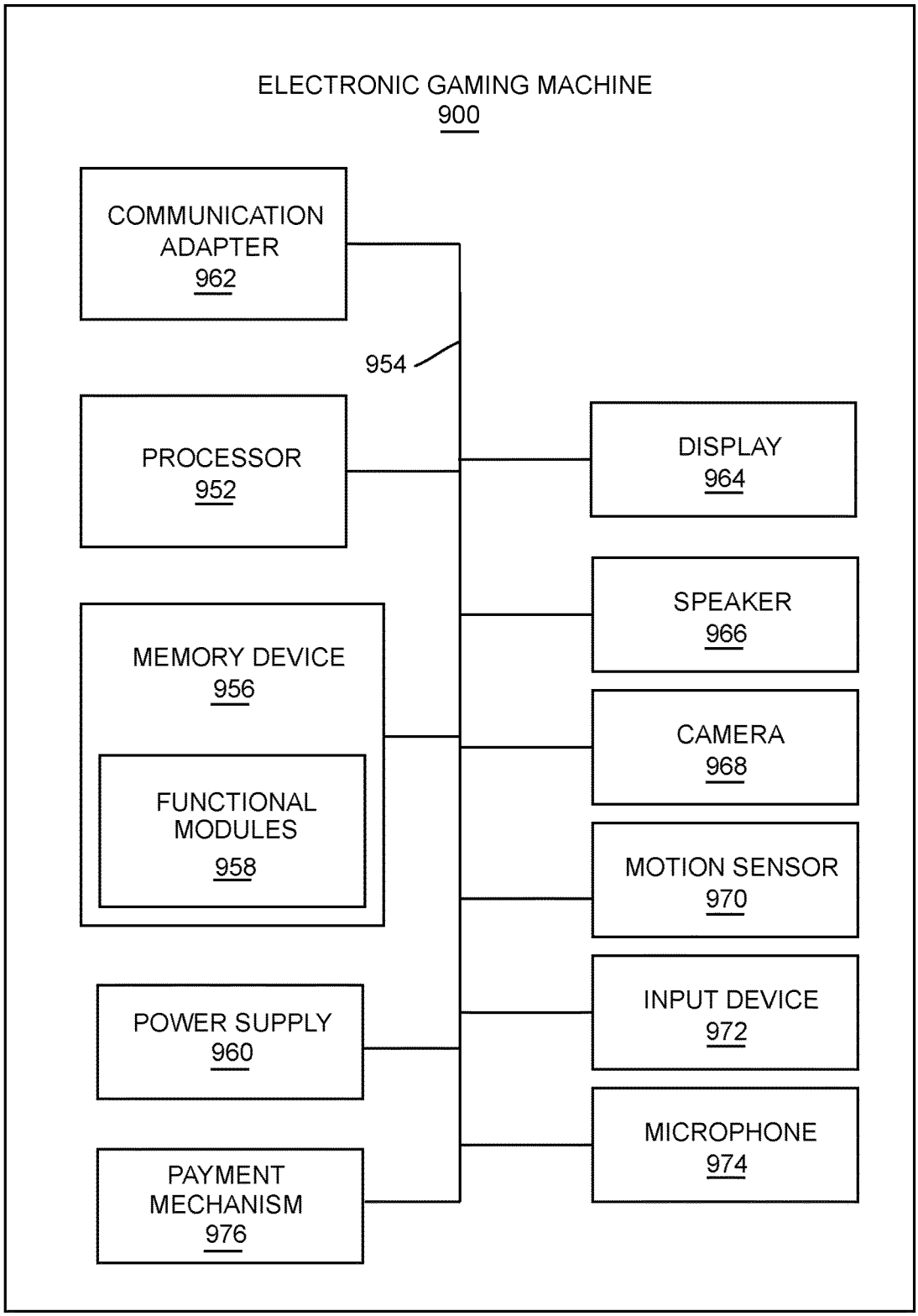
FIG. 9 is a block diagram that illustrates various components of an EGM according to some embodiments.

As discussed above, some embodiments include a configurable flexible display as part of an EGM having a number of additional components for interacting with the configurable flexible display. In this regard, reference is now made to FIG. 9, which is a block diagram that illustrates various components of an EGM 900, which may embody or include aspects of the features discussed above, according to some embodiments. As shown in FIG. 9, the EGM 900 may include a processor 952, or processing circuit, that controls operations of the EGM 900. Although illustrated as a single processor, multiple special purpose and/or general-purpose processors and/or processor cores may be provided in the EGM 900. For example, the EGM 900 may include one or more of a video processor, a signal processor, a sound processor and/or a communication controller that performs one or more control functions within the EGM 900. The processor 952 may be variously referred to as a "controller," "microcontroller," "microprocessor" or simply a "computer." The processor 952 may further include one or more application-specific integrated circuits (ASICs).

Various additional components of the EGM 900 are also illustrated in FIG. 9 as being connected to the processor 952. It will be appreciated that the components may be connected to the processor 952 and/or each other through one or more busses 954 including a system bus, a communication bus and controller, such as a USB controller and USB bus, a network interface, or any other suitable type of connection.

The EGM 900 further includes a memory device 956 that stores one or more functional modules 958 for performing the operations described above. Alternatively, or in addition, some of the operations described above may be performed by other devices connected to a network, for example. The EGM 900 may communicate with other devices connected to the network to facilitate performance of some of these operations. For example, the EGM 900 may communicate and coordinate with certain EGMs to identify players at a particular EGM.

The memory device 956 may store program code and instructions, executable by the processor 952, to control the EGM 900. The memory device 956 may include random access memory (RAM), which can include non-volatile RAM (NVRAM), magnetic RAM (MRAM), ferroelectric RAM (FeRAM) and other forms as commonly understood in the gaming industry. In some embodiments, the memory device 978 may include read only memory (ROM). In some embodiments, the memory device 956 may include flash memory and/or EEPROM (electrically erasable programmable read only memory). Any other suitable magnetic, optical and/or semiconductor memory may operate in conjunction with the display device disclosed herein.

The EGM 900 may include a power supply 960 that provides power to EGM 900 and its components. The power supply 960 may be a conventional power supply that may be plugged into an AC or DC electrical socket, or may be hard-wired into an electrical power system or grid, such as a building power supply. The power supply 960 may also include a battery that provides power to the EGM 900 and/or certain components in the event that the EGM is disconnected from an AC or DC power source, for example.

The EGM 900 may include a communication adapter 962 that enables the EGM 900 to communicate with remote devices, such as the wireless network, another EGM 900, and/or a wireless access point, over a wired and/or wireless communication network, such as a local area network (LAN), wide area network (WAN), cellular communication network, or other data communication network.

The EGM 900 may include one or more internal or external communication ports that enable the processor 952 to communicate with and to operate with internal or external peripheral devices and/or interface elements, such as a display 964, speakers 966, cameras 968, sensors, such as motion sensors 970, input devices 972, such as buttons, switches, keyboards, pointer devices, and/or keypads, mass storage devices, microphones 974, payment mechanisms 976 such as bill and/or coin acceptors/dispensers, credit/debit card readers, Bluetooth and/or near-field communication (NFC) interfaces or other interfaces for receiving and/or dispensing currency and/or credit, and wireless communication devices.

In the above-description of various embodiments, various aspects may be illustrated and described herein in any of a number of patentable classes or contexts including any new and useful process, machine, manufacture, or composition of matter, or any new and useful improvement thereof. Accordingly, various embodiments described herein may be implemented by hardware (including as stand-alone printed circuit boards (PCBs), induction coils, RGB LEDs, etc.), by software (including firmware, resident software, microcode, etc.) or by combining software and hardware implementation that may all generally be referred to herein as a "circuit," "module," "component," or "system." Furthermore, various embodiments described herein may take the form of a computer program product including one or more machine readable or computer readable media having machine readable program code embodied thereon.

Any combination of one or more computer readable media may be used. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random-access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Various embodiments were described herein with reference to flowchart illustrations and/or block diagrams of methods, apparatus (systems), devices and computer program products according to various embodiments described herein. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A method comprising:

providing, by a processing circuit of a gaming device, a primary game to a first player of the gaming device, the primary game comprising a plurality of outcomes;

in response to one of the plurality of outcomes, providing, by the processing circuit, a first game asset for a secondary game to the first player, wherein the first game asset does not have an initial value, and wherein providing the first game asset for a secondary game to the first player further comprises determining a player status of the first player and selecting the first game asset from a plurality of first game assets based at least in part on the player status of the first player; and during the secondary game, determining, by the processing circuit, a value for the first asset of the first player and a value for a second asset of a second player;

determining, by the processing circuit, an outcome of the secondary game based, at least in part, on comparing the values of the first game asset and the second game asset, and displaying, by a display device of the gaming device, the outcome of the secondary game to the player.

2. The method of claim 1, wherein the value of the first asset is determined independently of the primary game and the secondary game.

3. The method of claim 1, further comprising generating, via a second gaming device comprising a second processing circuit, the value of the first game asset in response to at least one game event during play of the secondary game.

4. The method of claim 1, wherein the secondary game is a fantasy sports game match, wherein the first and second game assets are fantasy sports team members, and wherein the first and second asset values are point values based on game events during the fantasy sports game match associated with the respective fantasy sports team members.

5. The method of claim 4, wherein at least one of the fantasy sports team members corresponds to a respective real-world sports team member, and wherein the point value associated with the respective real-world sports team member is based on a real-world game event associated with the respective real-world sports team member.

6. The method of claim 4, wherein at least one of the fantasy sports team members corresponds to a virtual team member, and wherein the point value associated with the respective virtual team member is based on a virtual game event associated with the respective virtual team member.

7. The method of claim 1, wherein the secondary game is a deck-building card game match, wherein the first and second game assets are cards for the deck-building card game match, and wherein the values of the first and second assets are point values based on game events during the deck-building card game match associated with the respective cards.

8. The method of claim 1, wherein the secondary game is a scavenger hunt game, wherein the first and second game assets are scavenger hunt items for the scavenger hunt game, and wherein the values of the first and second assets are point values associated with the respective scavenger hunt items.

9. The method of claim 1, further comprising:

after providing the first game asset to the first player via the gaming device at a first location, directing the first player to a second gaming device at a second location different from the first location to play the secondary game.

10. The method of claim 1, further comprising:

transferring, in response to a request by the first player, the first game asset from the first player to another player.

11. The method of claim 10, wherein transferring the first game asset from the first player to another player comprises trading the first game asset to another player in exchange for another game asset.

12. The method of claim 1, wherein selecting the first game asset from the plurality of first game assets further comprises:

in response to determining that the player status of the first player is higher than a threshold player status, selecting a first game asset having a higher rank among the plurality of first game assets than a threshold rank.

* * * * *